US009848717B2

(12) United States Patent
Nugroho et al.

(10) Patent No.: US 9,848,717 B2
(45) Date of Patent: Dec. 26, 2017

(54) REFRIGERATED SALES CABINET

(75) Inventors: Sri Nugroho, Mainz-Kastel (DE); Markus Schu, Wöllstein (DE)

(73) Assignee: CARRIER CORPORATION, Farmington, CT (US)

( * ) Notice: Subject to any disclaimer, the term of this patent is extended or adjusted under 35 U.S.C. 154(b) by 353 days.

(21) Appl. No.: 14/417,263

(22) PCT Filed: Aug. 1, 2012

(86) PCT No.: PCT/EP2012/065067
§ 371 (c)(1),
(2), (4) Date: Jan. 26, 2015

(87) PCT Pub. No.: WO2014/019621
PCT Pub. Date: Feb. 6, 2014

(65) Prior Publication Data

US 2015/0245721 A1 Sep. 3, 2015

(51) Int. Cl.
*F25D 21/14* (2006.01)
*A47F 3/04* (2006.01)

(52) U.S. Cl.
CPC ..... *A47F 3/0447* (2013.01); *A47F 3/0482* (2013.01); *F25D 21/14* (2013.01); *F25D 2321/146* (2013.01)

(58) Field of Classification Search
CPC .. A47F 3/0047; F25D 21/14; F25D 2321/146; F25D 17/047
See application file for complete search history.

(56) References Cited

U.S. PATENT DOCUMENTS

| | | | |
|---|---|---|---|
| 2,050,590 | A | 8/1936 | Smith |
| 3,626,713 | A | 12/1971 | Venable |
| 5,119,640 | A | 6/1992 | Conrad |
| 5,123,627 | A | 6/1992 | Hodges |
| 5,437,164 | A | 8/1995 | Consiglio |
| 7,174,739 | B2 | 2/2007 | Ozaki |
| 7,191,606 | B1 | 3/2007 | Dwyer |
| 7,392,821 | B2 | 7/2008 | Nakata et al. |
| 8,074,463 | B2 | 12/2011 | Bang |
| 2006/0042292 | A1 | 3/2006 | Kimbrough et al. |
| 2006/0277934 | A1 | 12/2006 | Cho |

(Continued)

FOREIGN PATENT DOCUMENTS

| | | | |
|---|---|---|---|
| DE | 202009011510 | U1 | 10/2009 |
| GB | 2170308 | A | 7/1986 |

(Continued)

OTHER PUBLICATIONS

International Search Report and Written Opinion for application PCT/EP2012/065067, dated Jun. 13, 2013, 13 pages.

*Primary Examiner* — Elizabeth Martin
(74) *Attorney, Agent, or Firm* — Cantor Colburn LLP

(57) ABSTRACT

A refrigerating cabinet (1) comprises at least one goods presentation and air circulation space (2), a refrigeration cycle for cooling the at least one goods presentation and air circulation space (2), and at least one drain conduit (36; 42) configured for draining condensed water, which is produced when the refrigeration circuit is operating, from the at least one goods presentation and air circulation space (2). At least a portion of the at least one drain conduit (36; 42) is filled with a granulate material (34) or provided with a movable flap (48) allowing water to pass through the drain conduit (36; 42) and blocking air from passing through the drain conduit (36; 42).

13 Claims, 3 Drawing Sheets

(56) References Cited

U.S. PATENT DOCUMENTS

| | | | |
|---|---|---|---|
| 2009/0011299 | A1 | 1/2009 | Yokoyama |
| 2009/0151383 | A1 | 6/2009 | Becker et al. |
| 2010/0269531 | A1 | 10/2010 | Samdan et al. |

FOREIGN PATENT DOCUMENTS

| | | | |
|---|---|---|---|
| JP | H0490481 | A | 3/1992 |
| WO | 2011023581 | A2 | 3/2011 |
| WO | 2011107884 | A2 | 9/2011 |

REFRIGERATED SALES CABINET

The present invention relates to a refrigerated sales cabinet. More particularly, the invention relates to a refrigerated sales cabinet comprising a drain conduit in order to dispose condensed water.

Refrigerated sales cabinets for presenting cooled and/or frozen goods to potential customers including standalone refrigerated sales cabinets, which comprise a complete refrigeration circuit and need only to be connected to an electric power supply in order to operate the refrigeration circuit, are known in the art.

The operation of the refrigeration circuit comprised in this kind of cabinets usually produces condensed water, in particular at the evaporator. Said condensed water needs to be disposed from the goods presentation and air circulation space in order to maintain an attractive goods presentation and in order to maintain the cooling capacity of the refrigeration circuit.

It is known in the art to collect the condensed water in a condensed water collecting container, which is arranged below the evaporator and comprises a drain conduit in order to drain the water which has been collected in the container. As warm air ascending through the drain conduit and flowing by the evaporator reduces the efficiency of the refrigeration circuit, the drain conduit usually is provided with a siphon which is filled with water in order to prevent warm air from ascending through the drain conduit.

Filling the siphon with water before starting the operation of the refrigerated sales cabinets and regularly checking the amount of water within the siphon are perceived as inconvenient by the personnel e.g. in the supermarkets, and these actions considerably increase the effort and the costs for the installation and the maintenance of the refrigerated sales cabinets.

It therefore would be beneficial to provide a refrigerated sales cabinet with reduced installation and maintenance effort and costs while continuing to provide a reliable removal of condensed water from the goods presentation and air circulation space.

A refrigerated sales cabinet according to a first exemplary embodiment of the invention comprises a goods presentation and air circulation space comprising a goods presentation space for supporting refrigerated goods to be sold and an air circulation space comprising an evaporator for cooling air flowing through the air circulation space. The refrigerated sales cabinet further comprises a drain conduit fluidly connecting a bottom part of the goods presentation and air circulation space with a position outside of the goods presentation and air circulation space. Said drain conduit is configured for draining condensed water forming within the goods presentation and air circulation space to a position outside of the goods presentation and air circulation space and comprises an at least partially permeable container arranged along the flow path of the drain conduit, wherein the container is filled with granulate material that is non-absorbent to water. The granulate material is piled up within the container so as to occupy the full diameter of the flow path such that air is hindered or even prevented from passing through the drain conduit from outside of the goods presentation and air circulation space into the goods presentation and air circulation space and such that water still can pass through the drain conduit from the goods presentation and air circulation space to the position outside of the goods presentation and air circulation space.

A refrigerated sales cabinet according to a second exemplary embodiment of the invention comprises a goods presentation and air circulation space comprising a goods presentation space for supporting refrigerated goods to be sold and an air circulation space comprising an evaporator for cooling air flowing through the air circulation space. The refrigerated sales cabinet further comprises a drain conduit fluidly connecting a bottom part of the goods presentation and air circulation space with a position outside of the goods presentation and air circulation space. Said drain conduit is configured for draining condensed water forming within the goods presentation and air circulation space to a position outside of the goods presentation and air circulation space. The end of the drain conduit at the position outside of the goods presentation and air circulation space is facing upwards forming an angle of more than 0° with respect to a vertical plane. A flap is provided at said end of the drain conduit. Said flap is moveable between a closed position, in which the flap rests on said end of the drain conduit and hinders or even prevents air passing through the drain conduit from outside of the goods presentation and air circulation space into the goods presentation and air circulation space, and an open position, in which the flap is raised from said end of the drain conduit allowing water to pass through the drain conduit from the goods presentation and air circulation space to the position outside of the goods presentation and air circulation space.

In the refrigerated sales cabinets according to exemplary embodiments of the invention no water has to be present in the drain conduit in order to hinder warm air from ascending through the drain conduit into the goods presentation and air circulation space. Instead, air is blocked by the granulate material or the movable flap, respectively, from flowing through the drain conduit. At the same time the granulate material or the movable flap respectively allow condensed water to pass through the drain conduit in order to be removed from the water collecting container.

In consequence the invention provides refrigerated sales cabinets which may be installed and operated more conveniently as it is not necessary to ensure the presence of water in the drain conduit.

In the following the invention will be described in more detail with reference to the enclosed figures.

Figure 1:
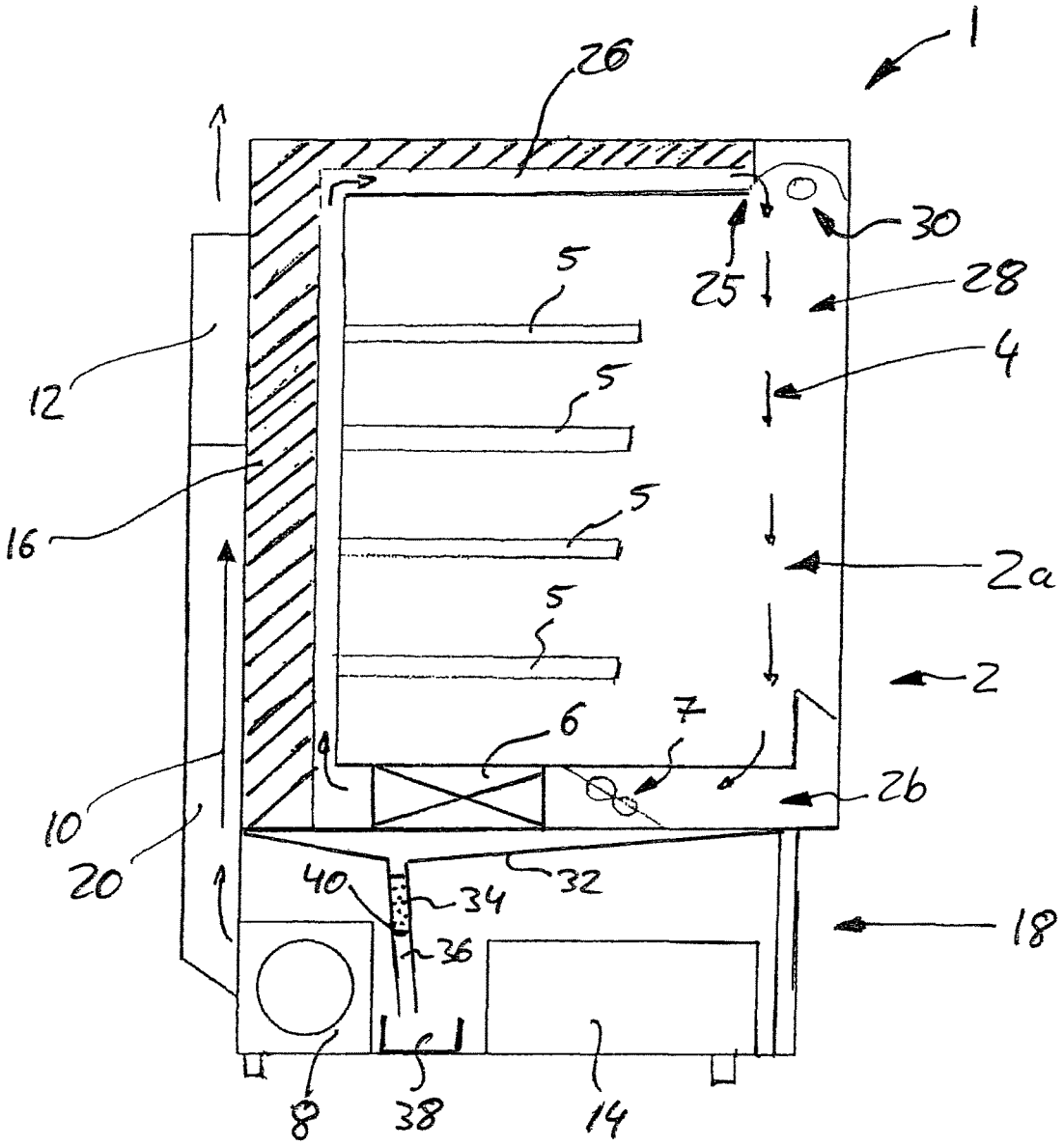
FIG. 1 shows a schematic cross section of an example of an integrated refrigerated sales cabinet according to a first embodiment of the invention.

The exemplary embodiment of a refrigerated sales cabinet 1 shown in FIG. 1 in particular is a standalone cooling or freezing cabinet to be used in department and/or grocery stores or the like in order to present cooled and/or frozen goods to the customers. It is, however, self-evident to the skilled person that the invention may be implemented in any kind of refrigeration sales cabinets comprising a drain conduit in order to discharge condensed water.

The exemplary refrigerated sales cabinet 1 shown in FIG. 1 has a goods presentation and air circulation space 2 comprising a refrigerateable goods storage and presentation space 2*a* and an air circulation space 2*b*. The air circulation space 2*b* may be integral with the goods storage and presentation space 2*a*. In an alternative embodiment the air circulation space 2*b* may be separated from the goods storage and presentation space 2*a* by means of a barrier.

The refrigerateable goods storage and presentation space 2*a* comprises a plurality of goods presentation racks 5 for receiving the goods to be cooled and presented. The refrigerated sales cabinet 1 comprises a front opening 28 allowing access to the goods presented within the goods storage and presentation space 2*a*.

Means for generating a first stream 4 of cooled air for cooling the refrigerateable goods storage and presentation space 2*a* and any goods (not shown) comprised therein are provided by means of a first fan 7 and a cooled air channel 26 directing a first stream 4 of air from a lower portion of the goods storage and presentation space 2*a* by an evaporator 6, which is arranged in the air circulation space 2*b* below the goods storage and presentation space 2*a*, through an air outlet 25 provided at an upper portion of the goods storage and presentation space 2*a*.

A compressor 14 and a second fan 8 are arranged in a lower bottom portion 18 of the refrigerated sales cabinet 1 which is arranged below the goods presentation and air circulation space 2. The second fan 8 is provided for generating a second air stream 10 which is directed through a rear air duct 20 past a condenser 12 arranged at an upper portion of an upper rear wall 16 defining the goods storage and presentation space 2*a*. The compressor 14, the condenser 12, the evaporator 6 and an expansion device (not shown) form a refrigerating circuit, as it is known in the art.

When the refrigerating circuit is operating, the evaporator 6 cools the first stream 4 of air, which is guided through the air circulation space 2*b* by the evaporator 6 via the cooled air channel 26 and the air outlet 25 into the goods storage and presentation space 2*a* in order to cool the goods provided on the goods presentation racks 5.

A roller blind 30 or a similar curtain is arranged at the top of the front opening 28 of the goods storage and presentation space 2*a* allowing to close the front opening 28, e.g. during the night, providing a separation between the goods storage and presentation space 2*a* and the outer region in order to hinder or even prevent an exchange of cold air flowing out of the goods storage and presentation space 2*a* with warm air from the environment of the refrigerated sales cabinet 1.

During normal opening hours the roller blind 30 is usually open in order to allow an easy access to the goods presented on the racks 5. Alternatively, the blind 30, which may be transparent, may be opened only for accessing the goods. Instead of a blind 3 a sliding or swinging door may be provided, which may be transparent, as well.

When the refrigeration circuit is operating, humidity comprised in the first stream 4 of air flowing through the air circulation space 2*b* will condense within the air circulation space 2*b*, in particular at the evaporator 6. If the refrigerated sales cabinet 1 is operated at freezing temperatures, the condensed water may freeze forming a layer of ice on the evaporator 6. In this case the evaporator 6 needs to be defrosted regularly in order to maintain or restore its cooling capacity.

In order to collect condensed water including melting water dropping from the evaporator 6, a water collecting container 32 is arranged at the bottom of the air circulation space 2*b*. The water collecting container 32 is provided with a drain conduit 36 in order to drain condensed water collected in the collecting container 32 to a reservoir 38, which is arranged within the lower bottom portion 18 of the refrigerated sales cabinet 1. The drain conduit 36 is arranged at a steep angle, e.g. in the range of 70° to 90°, with respect to the horizontal in order to allow the condensed water to flow through the drain conduit 36 driven by its own weight.

The reservoir 38 may be heated, e.g. by means of waste heat generated by the operation of the compressor 14, in order to evaporate the water collected in the reservoir 38 to the second air stream 10 passing through a lower bottom portion 18 of the refrigerated sales cabinet 1.

As a stream of warm air flowing into the air circulation space 2*b* would reduce the efficiency of the refrigeration circuit considerably, it is beneficial to avoid warm air from ascending through the drain conduit 36 from the lower bottom portion 18 of the refrigerated sales cabinet 1 into the water collecting container 32 and the air circulation space 2*b*.

In the first embodiment shown in FIG. 1 a portion of the drain conduit 36 is filled with a granulate material 34, so as to occupy the full diameter of the drain conduit 36. The granulate material 34 is configured to allow water to pass through the drain conduit 36 from the top to the bottom of the drain conduit 36, but to block air from ascending through the drain conduit 36 into the air circulation space 2*b*.

The granulate material 34 may comprise pellets 52 and/or gravel filled in a container 54, 56, for example a net-bag 54 or a cartridge 56, which is part of or inserted into the drain conduit 36. A support 40 may be provided in the drain conduit 36 in order to respectively support the container 54, 56 within the drain conduit 36. The support 40 may be formed as a grid or orifice reducing the diameter of the drain conduit 36 in order to prevent the container 54, 56 from dropping out of the drain conduit 36.

The longest extension of each of the pellets 52 may be in the range between 2 mm and 5 mm. The pellets 52 in particular may have a longest extension of 3 mm. Pellets 52 having this extension have proven to provide a granulate material 34 which is well suited for the intended purpose. The pellets 52 may be balls having a constant diameter.

Alternatively or additionally the granulate material 34 may comprise gravel. Gravel provides a cheap granulate material 34, which, is well suited for the intended purpose.

Alternatively or additionally the granulate material 34 may comprise a synthetic material and/or silicium. The granulate material 34 in particular may comprise at least one of glass, stone, gravel, plastics, polymer, silicium, or a metal material, particularly steel or aluminium respectively providing a cheap granulate material which is well suited for the intended purpose.

Figure 2:
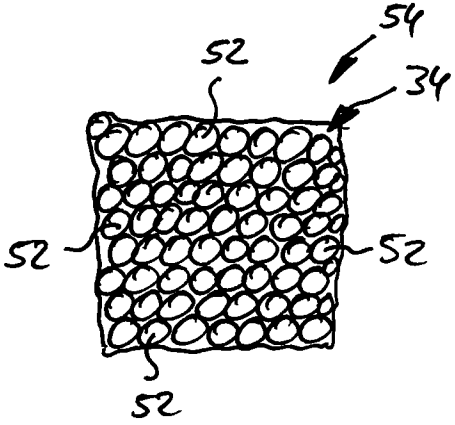
FIG. 2 shows a schematic cross section through a net-bag filled with a granulate material according to an embodiment of the invention.

FIG. 2 shows a schematic cross section though a net-bag 54 filled with granulate material 34 comprising a plurality of pellets 52. The net-bag 54 may be formed as a net and/or from a textile material in order to allow water to pass through the net-bag 54. The net-bag 54 may be made of plastic material. A net-bag 54 made of plastic material is cheap and long durable.

Figure 3:
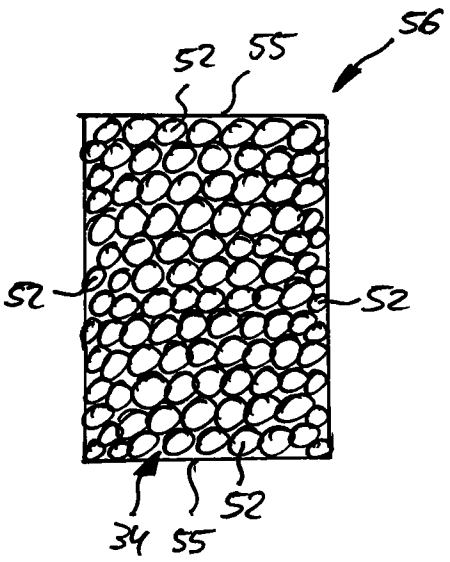
FIG. 3 shows a schematic cross section through a cartridge filled with a granulate material according to an embodiment of the invention.

FIG. 3 shows a schematic cross section through a cartridge 56 filled with granulate material 34 comprising a plurality of pellets 52. The upper and lower walls 55 of the cartridge 56 comprise openings or a water permeable membrane in order to allow water to pass through the walls 55 into and out of the cartridge 56. The cartridge 56 may be removeably attached to the drain conduit 34 forming a portion of said drain conduit 34. A removable cartridge 56 allows to replace the granulate material 34 easily and conveniently, if necessary. The cartridge 56 may be made of a plastic or metal material or a mixture thereof.

For the simplicity of illustration the pellets 52 forming the granulate material 34 shown in FIGS. 2 and 3 are arranged in an almost regular order. The skilled person, however, will understand that the elements of a granulate material 34 are in general arranged chaotically without any order.

Figure 4:
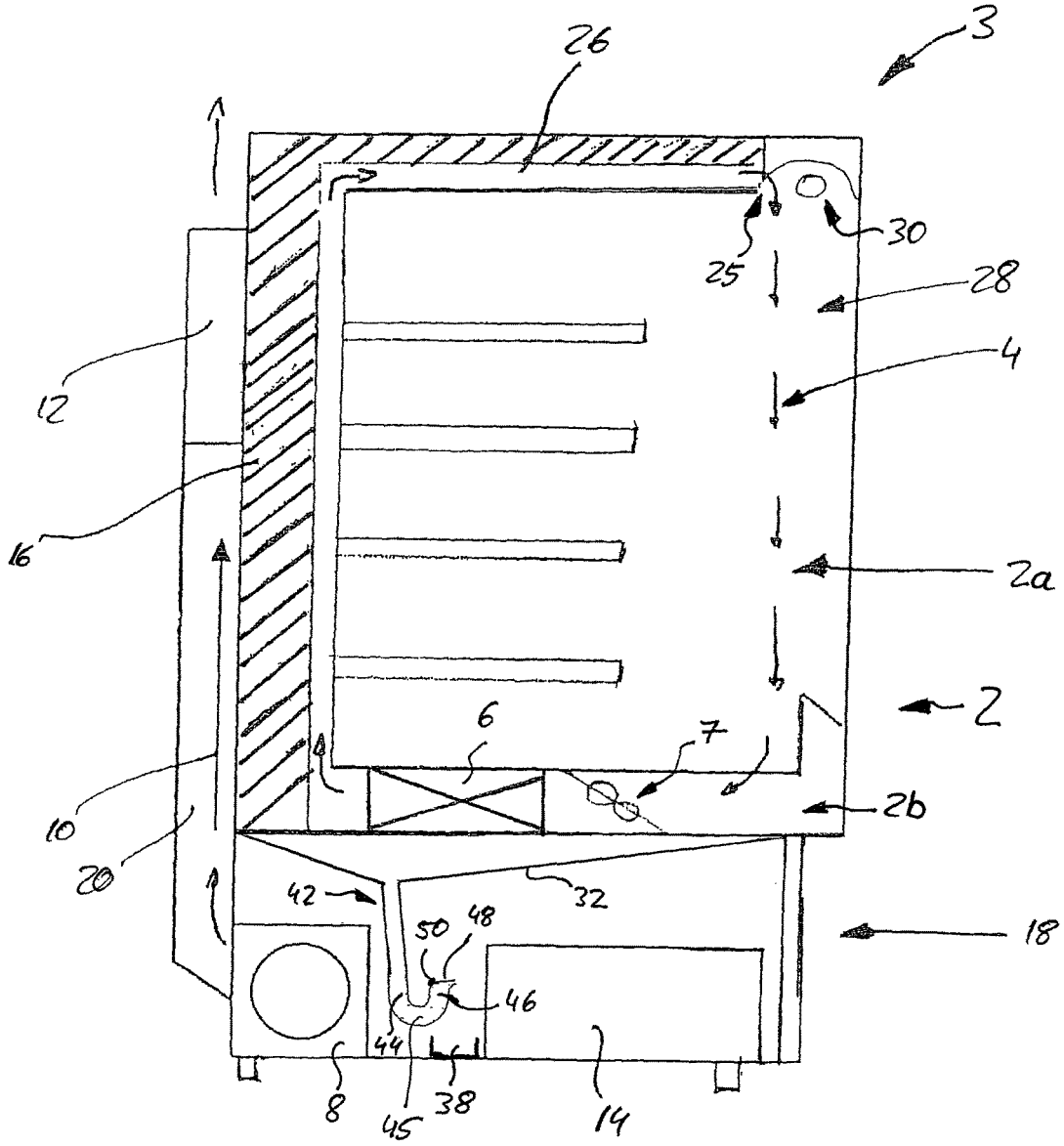
FIG. 4 shows a schematic cross section of an example of an integrated refrigerated sales cabinet according to a second embodiment of the invention.

FIG. 4 shows an example of an integrated refrigerated sales cabinet 3 according to a second exemplary embodiment of the invention.

The features of the refrigerated sales cabinet 3 according to the second embodiment shown in FIG. 3 which are identical to the features of the refrigerated sales cabinet 1 according to the first embodiment shown in FIG. 1 are denoted with the same reference signs and will not be discusses in detail again.

In the refrigerated sales cabinet 3 according to the second embodiment at least a portion of the drain conduit 42 comprises a first conduit 44 and a second conduit 46 which extend in a basically vertical direction parallel to each other. The lower ends of the first and second conduits 44, 46 are fluidly connected to each other by a bottom portion 45 of the drain conduit 42, the bottom portion 45 being connected between the first conduit 44 and the second conduit 46 so that the first conduit 44, the bottom portion 45 and the second conduit 46 form a basically U-shaped siphon.

An upper end of the first conduit 44 opposite to the bottom portion 45 is fluidly connected to the bottom of the collecting container 32 in order to receive condensed water which has been collected in the collecting container 32. The upper end of the second conduit 46 is open in order to allow condensed water flowing out of the collecting container 32 to spill out of the upper end of the second conduit 46 into the reservoir 38, which is arranged below the opening provided at the upper end of the second conduit 46.

In order to hinder air from entering into the drain conduit 42 via the opening provided at the upper end of the second conduit 46, a moveable flap 48 is arranged at an upper end of the second conduit 46. The moveable flap 48 may be attached to the upper end of the second conduit 46 by means of a joint or hinge 50 allowing the flap 48 to pivot with respect to the second conduit 46.

In case no water is spilling out of the drain conduit 42, the moveable flap 48 is moved into a closed position, in which it rests in the upper end of the second conduit 46, by its own weight. In said closed position the moveable flap 48 seals the opening provided at the upper end of the second conduit 46 and hinders or prevents air from flowing through the opening into the second conduit 46.

In case a sufficient amount of condensed water is flowing from the collecting container 32 into the drain conduit 42, the water will push up the flap 48 into an open position allowing the water to spill out of the drain conduit 42 into the reservoir 38, which is arranged at the very bottom of the cabinet 1 below the opening of the second conduit 46. From the reservoir 38 the water is evaporated into the second air stream 10, as it has been described with reference to the first embodiment.

Condensed water which is collected in the bottom portion 45 of the drain conduit 42 similar to a traditional siphon will provide an additional sealing hindering air from ascending through the drain conduit 42 into the collecting container 32. However, even if no water is present in the bottom portion 45 of the drain conduit 42, the air will be blocked reliably by means of the movable flap 48 when it is positioned in its closed position, as it has been described before.

The movable flap 48 may be made of an elastic material. An elastic material allows the movable flap 48 to move without providing a joint or hinge 50. A movable flap 48 made of an elastic material further is well suited for tightly sealing the opening of the drain conduit 42. In an embodiment the movable flap 48 is made of a synthetic material. A synthetic material may provide a cheap and long durable movable flap 48.

As a result, the refrigerated sales cabinets 1, 3 according to exemplary embodiments of the invention reliably hinder or even prevent air form ascending through the drain conduit 36, 42, which is provided for discharging condensed water, without the need of providing a certain amount of water in the drain conduit 36, 42. Thus, the refrigerated sales cabinets 1, 3 according to exemplary embodiments of the invention may be installed and operated more conveniently than refrigerated sales cabinets as they are known from the prior art, and less maintenance is needed.

The exemplary embodiments of a refrigerated sales cabinets 1, 3 shown in FIGS. 1 and 3 are standalone refrigerated cabinets respectively comprising a complete refrigeration circuit, which need to be connected only to an electric power supply for operation. Alternatively, a refrigerated sales cabinet may comprise only at least one evaporator to be fluidly connected to an external refrigeration circuit installed in the building in which the refrigerated sales cabinet is placed.

In an embodiment the drain conduit has a straight, non-bent shape and the longitudinal axis of the drain conduit forms an angle of 70 to 90° with the horizontal. A straight drain conduit is easy to produce at low costs and arranging the conduit at such an angle allows condensed water to flow through the conduit driven by its own weight.

In an embodiment the container, which is filled with the granulate material, forms a segment of the drain conduit. This provides a convenient way of providing the container including the granulate material within the drain conduit.

In an embodiment the container being filled with the granulate material is a cartridge, which is positioned within the drain conduit. A cartridge filled with granulate material and being positioned within the drain conduit allows to conveniently arrange the granulate material within the drain conduit and to remove the granulate material from the drain conduit, if necessary.

In an embodiment the container has a lower permeable wall onto which the granulate material is piled up providing a suitable means for placing the granulate material within the drain conduit. The permeable wall allows water to flow through the container.

The permeable wall may comprise a water-permeable membrane or openings having a diameter which is smaller than the smallest diameter of the elements forming the granulate material in order to prevent the granulate material from leaving the container.

In an embodiment the container, which is filled with the granulate material, is formed as a net-bag positioned within the drain conduit. A net-bag provides a suitable container for placing the granulate material within the drain conduit, which may be produced a low costs. The openings in the net-bag may be smaller than diameter of the granulate material in order to prevent the granulate material from leaving the net-bag or the container.

The net-bag or cartridge may be made of at least one of a net material, a textile material, or plastics material, each of which provides a cheap and well suited material allowing water to pass through the net-bag but preventing the granulate material from leaving the net-bag.

In an embodiment the drain conduit comprises a support for supporting the net-bag or cartridge. A support supporting the net-bag or cartridge within the drain conduit avoids that the net-bag or cartridge drops or is flushed out of the drain conduit.

In an embodiment the support is formed as a grid or as an orifice. A grid and an orifice respectively provide an adequate support, which may be produced and installed easily at low costs.

In an embodiment the granulate material comprises a plurality of pellets. Pellets have proven to provide a well suited granulate material reliably blocking air from flowing through the drain conduit but allowing water to pass through the material.

In an embodiment the granulate material comprises elements having a rounded and/or smooth surface. Elements having a rounded and/or smooth surface provide a well suited air-tight but water permeable granulate material.

The elements forming the granulate material may be uniform in size providing a homogeneous granulate material. Alternatively the elements forming the granulate material may have varying sizes providing a inhomogeneous granulate material.

The longest extension of the elements may be in the range of 2 mm to 5 mm, in particular approximately 3 mm. Elements having this size have proven to provide a well-suited granulate material.

In an embodiment the pellets are formed as balls, which have proven to provide a well suited granulate material.

The granulate material may comprise at least one of glass, stone, gravel, plastics, polymer, silicium, or a metal material, particularly steel or aluminium, which all have proven to respectively provide a well suited granulate material.

In an embodiment the fill level of the granulate material within in the container is at least 20 mm in order to provide a reliable air-seal within the drain conduit.

In an embodiment the granulate material comprises a material which does not absorb water and/or which is water repellent. This avoids that the material absorbs the water forming a wet mass which completely seals the drain conduit and does not allow any water to pass through the drain conduit.

In an embodiment the movable flap is configured to be moved into its closed position by means of gravity, in particular by its own weight. This reliably ensures that the flap is in its closed position blocking the flow of air through the drain conduit if no water is flowing through the drain conduit.

In an embodiment the movable flap is configured to be moved into the open position by means of the pressure of condensed water flowing through the drain conduit. This ensures that condensed water may always flow out of the drain conduit and is not blocked by a closed flap.

In an embodiment the flap is attached to the drain conduit by means of a joint or hinge allowing the flap to pivot with respect to the drain conduit. A joint or hinge allows an easy movement of the flap, ensuring that the flap opens and closes properly.

In an embodiment the flap is made of an elastic material. An elastic material allows the flap to move without providing a joint or hinge. A flap made of an elastic material further is well suited for tightly sealing the opening of the drain conduit.

In an embodiment the flap is made of a synthetic material. A synthetic material provides a cheap and long durable flap.

In an embodiment at least a portion of the drain conduit is form as a U-shaped siphon comprising at least two conduits, the flap being arranged at an upper end of one of the drain's conduits. A U-shaped drain conduit allows an easy installation of a flap which is moved into a closed position closing the drain conduit by means of gravity. Water collected at the lowest portion of the U-shaped siphon provides an additional air-seal.

In an embodiment the position outside of the goods presentation and air circulation space to which the drain conduit drains the condensed water is a water reservoir positioned in a bottom part of the refrigerated sales cabinet below the goods presentation and air circulation space in order to avoid that the condensed water leaving the drain conduit distributes in the lower portion of the cabinet.

In an embodiment the refrigerated sales cabinet comprises means for evaporating the condensed water collected in the reservoir. Evaporating the water collected in the reservoir using e.g. the waste heat of the refrigeration circuit is a convenient way for disposing the water from the reservoir.

The skilled person will easily understand that the first and the second embodiments of the invention as respectively shown in FIGS. 1 and 4 may be combined by providing the drain conduit with both, a granulate material and a flap, in order to provide an even more reliable blocking of air from flowing through the drain conduit.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention is not limited to the particular embodiment disclosed, but that the invention will include all embodiments falling within the scope of the appended claims.

REFERENCE NUMERALS

1 refrigerated sales cabinet (first embodiment)
2 goods presentation and air circulation space
2*a* goods storage and presentation space
2*b* air circulation space
3 refrigerated sales cabinet (second embodiment)
4 first air stream
5 goods presentation racks
6 evaporator
7 first fan
8 second fan
10 second air stream
12 condenser
14 compressor
16 rear wall
18 lower bottom portion of the cabinet
20 rear air duct
25 air outlet
26 cooled air channel
28 front opening
30 roller blind
32 water collecting container
34 granulate material
36 drain conduit (first embodiment)
38 reservoir
40 support
42 drain conduit (second embodiment)
44 first conduit
45 bottom portion of the drain conduit
46 second conduit
48 moveable flap
50 joint or hinge
52 pellets
54 net-bag

55 upper and lower permeable walls of the cartridge
56 cartridge

The invention claimed is:

1. A refrigerated sales cabinet comprising:

a goods presentation and air circulation space for supporting refrigerated goods to be sold;

an evaporator for cooling air flowing through the goods presentation and air circulation space; and a drain conduit connecting a bottom part of the goods presentation and air circulation space with a position outside of the goods presentation and air circulation space, said drain conduit being configured for draining condensed water forming within the goods presentation and air circulation space to a position outside of the goods presentation and air circulation space;

wherein the drain conduit comprises an at least partially permeable container arranged along the flow path of the drain conduit, the container being filled with granulate material that is non-absorbent to water, and the granulate material being piled up within the container so as to occupy the diameter of the flow path such that air is hindered from passing through the drain conduit from outside of the goods presentation and air circulation space into the goods presentation and air circulation space and such that water still can pass through the drain conduit from the goods presentation and air circulation space to the position outside of the goods presentation and air circulation space.

2. The refrigerated sales cabinet of claim 1, wherein the drain conduit has a straight, non-bent shape and the longitudinal axis of the drain conduit forms an angle of 70 to 90° with the horizontal.

3. The refrigerated sales cabinet of claim 1, wherein the container being filled with granulate material forms a segment of the drain conduit.

4. The refrigerated sales cabinet of claim 3, wherein the container has a lower permeable wall onto which the granulate material is piled up.

5. The refrigerated sales cabinet of claim 1, wherein the container being filled with granulate material forms a cartridge positioned within the drain conduit.

6. The refrigerated sales cabinet of claim 5, wherein the drain conduit comprises a support, particularly a grid or an orifice, for supporting the container within the drain conduit.

7. The refrigerated sales cabinet of claim 1, wherein the container being filled with granulate material is formed as a net-bag positioned within the drain conduit.

8. The refrigerated sales cabinet of claim 1, wherein the fill level of the granulate material within in the container is at least 20 mm.

9. The refrigerated sales cabinet of claim 1, wherein the granulate material comprises elements having a rounded and/or smooth surface.

10. The refrigerated sales cabinet of claim 9, wherein the elements are of uniform size, the longest extension of the elements being in the range of 2 mm to 5 mm, particularly 3 mm approximately.

11. The refrigerated sales cabinet of claim 9, wherein the elements are of varying size, the longest extension of the elements being in the range of 2 mm to 5 mm.

12. The refrigerated sales cabinet of claim 1, wherein the granulate material comprises a plurality of pellets, particularly balls.

13. The refrigerated sales cabinet of claim 1, wherein the granulate material comprises at least one of glass, stone, gravel, plastics, polymer, silicium, or a metal material, particularly steel or aluminium.

* * * * *